United States Patent [19]

Godfrey

[11] 4,367,688

[45] Jan. 11, 1983

[54] SAILBOAT RIG

[76] Inventor: Thomas B. A. Godfrey, Coombs Neck, Vinalhaven, Me. 04863

[21] Appl. No.: 215,652

[22] Filed: Dec. 12, 1980

[51] Int. Cl.[3] ..... B63H 9/04

[52] U.S. Cl. ..... 114/39; 114/107

[58] Field of Search ..... 114/39, 89, 90, 91, 114/92, 95, 97, 98, 102, 103, 104, 105, 106, 107, 108, 230, 369, 370; 9/35, 36

[56] References Cited

U.S. PATENT DOCUMENTS

| | | | |
|---|---|---|---|
| 2,107,303 | 2/1938 | Ljungstrom | 114/106 |
| 3,310,017 | 3/1967 | Dyer | 114/98 |
| 3,426,719 | 2/1969 | Mizell | 114/230 |
| 3,851,610 | 12/1974 | Greene | 114/106 |
| 4,186,680 | 2/1980 | Harpole | 114/103 |
| 4,230,060 | 10/1980 | McCoy | 114/102 |

FOREIGN PATENT DOCUMENTS

| | | | |
|---|---|---|---|
| 7901568 | 8/1980 | Netherlands | 114/106 |
| 656400 | 8/1951 | United Kingdom | 114/102 |

OTHER PUBLICATIONS

*Sail, Theory and Practice,* by C. A. Marchaj, 1964, p. 100 and FIG. 64.

James H. Kyle, "The Butterfly Rig", *Cruising World,* pp. 32–34, Mar. 1978.

McCloskey, R. G. "The Wind is Free", *Rudder* vol. 72, No. 1; Jan. 1956.

*Primary Examiner*—Trygve M. Blix

*Assistant Examiner*—Jesus D. Sotelo

*Attorney, Agent, or Firm*—W. R. Hulbert

[57] ABSTRACT

Sailboat having twin booms, doubled sail and rotatable mast permits conventional sailing with both booms and sail sections on same tack or with booms spread, wing and wing, to run before the wind or on a reach. Sail may be reefed or furled by rotating the mast.

19 Claims, 9 Drawing Figures

SAILBOAT RIG

BACKGROUND OF THE INVENTION

Sailboats require more or less sail area for efficient propulsion corresponding to lower or higher wind strengths and to lower or higher apparent wind velocities resulting from varying courses relative to true wind direction. The effectiveness of sails is greatly influenced by control of the flow of air over them. Factors in effecting such control include their position relative to the wind, their shape, particularly the shape of the leading edge, and their size.

The traditional configuration of sail attached to the trailing edge of the mast produces turbulent flow and reduced lift, i.e. effectiveness. Customary reduction of sail area involves partial lowering of the sail and its securing to the boom or winding it up on a rotatable member in a hollow mast (U.S. Pat. No. 3,835,804). Increasing available sail area requires spreading of additional units of sail. Attempts to eliminate undesirable air flow have led to more and more complex, sophisticated, and expensive mast and rig systems and more burdensome demands on crews. For example, U.S. Pat. No. 4,061,101 discloses a doubled sail with improved air foil characteristics on a single boom, the sail being capable of being wound up within a sheath which is part of the mast. A traditional sail which may be rolled on a rotatable mast is shown in U.S. Pat. No. 2,107,303.

It would be desirable to provide a sailboat rig which would at once ensure smooth and efficient airflow over a desired area of sail, quick and easy increase or reduction of that area, and simple control of sail on all points of sailing, and which would satisfy these goals with simple, sturdy construction, eliminating the need for complex systems of stays, shrouds, trunbuckles, vangs, reefing lines, and all other costly and failure prone paraphernalia, and thus simplifying maintenance and crew demand while ensuring efficient performance under sail.

The object of the invention is to provide just such a rig, employing a doubled sail, twin booms and rotatable mast system permitting use of the doubled sail in conventional manner for sailing close to the wind, but readily doubling the effective sail area when sailing on a reach, directly before the wind or to windward in very light air. In either mode of operation the sail provides improved air foil characteristics with reduced turbulence caused by the presence of the mast.

SHORT STATEMENT OF THE INVENTION

In accordance with the invention, I provide, in a sailboat having a rotatable mast, the combination comprising twin booms pivotally connected to the lower part of the mast so as to swing independently of mast rotation in a horizontal plane together to the same side of the boat, or separately to opposite sides of the boat, and a single, generally triangular said passed around the mast and adapted to be rolled up thereon or unrolled therefrom when the mast rotates with one corner of the triangle comprising the head of the sail, the other two corners comprising the clews and the base of the sail, where it passes about the mast, comprising the tack, the clews being adapted for outhauling one on each boom when the mast rotates in its unrolling direction whereby, when said booms are together and the two sail sections outhauled, one-half the unrolled said area is exposed to the wind to provide an efficient, air foil leading edge at the mast, and, when the booms are separated, the entire unrolled sail area is exposed to the wind for running and reaching.

Preferred embodiments include one or more of the following: a releasable downhaul for the tack of the sail so that when the sail is fully unrolled, the booms separated and the downhaul slacked, the tack is released from the mast and the full area of the sail is exposed to the wind as an air foil without interference from the leading edge of the mast; means for rotating the mast whereby the sail may be rolled up entirely or only partially on the mast permitting incremental reefing in proportion to the number of turns of the mast; twin goosenecks to support the booms for swinging in both horizontal and vertical planes, each gooseneck being so shaped as to provide maximum movement of its attached boom in both horizontal and vertical planes with positive control of such movements; each of said goosenecks being preferably generally trapezoidal in configuration with its boom pivoted at the outboard upper corner and having combination lift vang means pivotally connecting its outboard lower corner to the corresponding boom; an upwardly sloping vortex plate at the top of the mast and means for raising and holding the head of the sail to the top of the mast, such means including a halyard and twin leads therefrom connected to spaced connecting means at the sail head which, when the sail is fully raised, are located on either side of the trailing edge of the mast and against the underside of the vortex plate; downhaul means controllable from the boat's control station connected to the tack of the sail for holding the tack against the base of the mast on both sides of the trailing edge thereof; means supporting the mast on the hull of the boat including a fixed tube extending from the bottom of the mast to the boat's keel, rigidly attached to both deck and keel, and including means for rotating the mast comprising a rotatable tube journaled within the fixed tube in driving relation to the mast and means for rotating the rotatable tube; means pivotally supporting the goosenecks on the fixed tube for supporting the booms for swinging together or separately in a horizontal plane; means pivoting the booms to the goosenecks for swinging in vertical planes to any desired angle, including the vertical; combination lift vangs interconnecting each boom to a portion of its gooseneck so as normally to urge such boom upwardly and control means acting against the force of the lift vangs for preventing such upward movement and positively adjusting the vertical positions thereof; generally trapezoidal goosenecks each with a vertical edge adjacent the mast hinged to the fixed tube for swinging through an arc permitting arcuate separation of the booms through an arc of the order of 270°-300°, its boom pivoted for vertical swinging movement to its outboard upper corner and its vang pivoted to its outboard lower corner; means for rotating the rotatable tube comprising a cable passed about a spool affixed to the base of the rotatable tube; power means controllable from the control station of the boat for actuating the aforesaid cable; means controllable from the control station of the boat for swinging the goosenecks and booms which means may comprise manual controls or, in a powered embodiment, a ring gear engaged by individual pinions in driving relation to the goosenecks respectively so that they may be individually or together swung horizontally through any desired arc and power means for actuating the pinions; a hydraulically powered combination lift vang interconnecting each boom to a portion of its gooseneck and means controllable from the control station of the boat for actuating the vangs so as to raise or lower the booms and maintain them at the desired elevation; power means for swinging the booms together in the same direction or separately in opposite directions whereby, when the boat is headed squarely or obliquely into the wind, the sail may be positioned to face the wind thereby braking said boat or driving it in reverse; and power means for raising and lowering each boom whereby when no sail is set the booms may be used as derricks for loading and unloading cargo from the boat.

Still further objects, features and advantages of the invention will become apparent from the following detailed non-limiting description of preferred embodiments thereof taken in conjunction with the accompanying drawings.

DETAILED DESCRIPTION OF PREFERRED EMBODIMENTS

Figure 1:
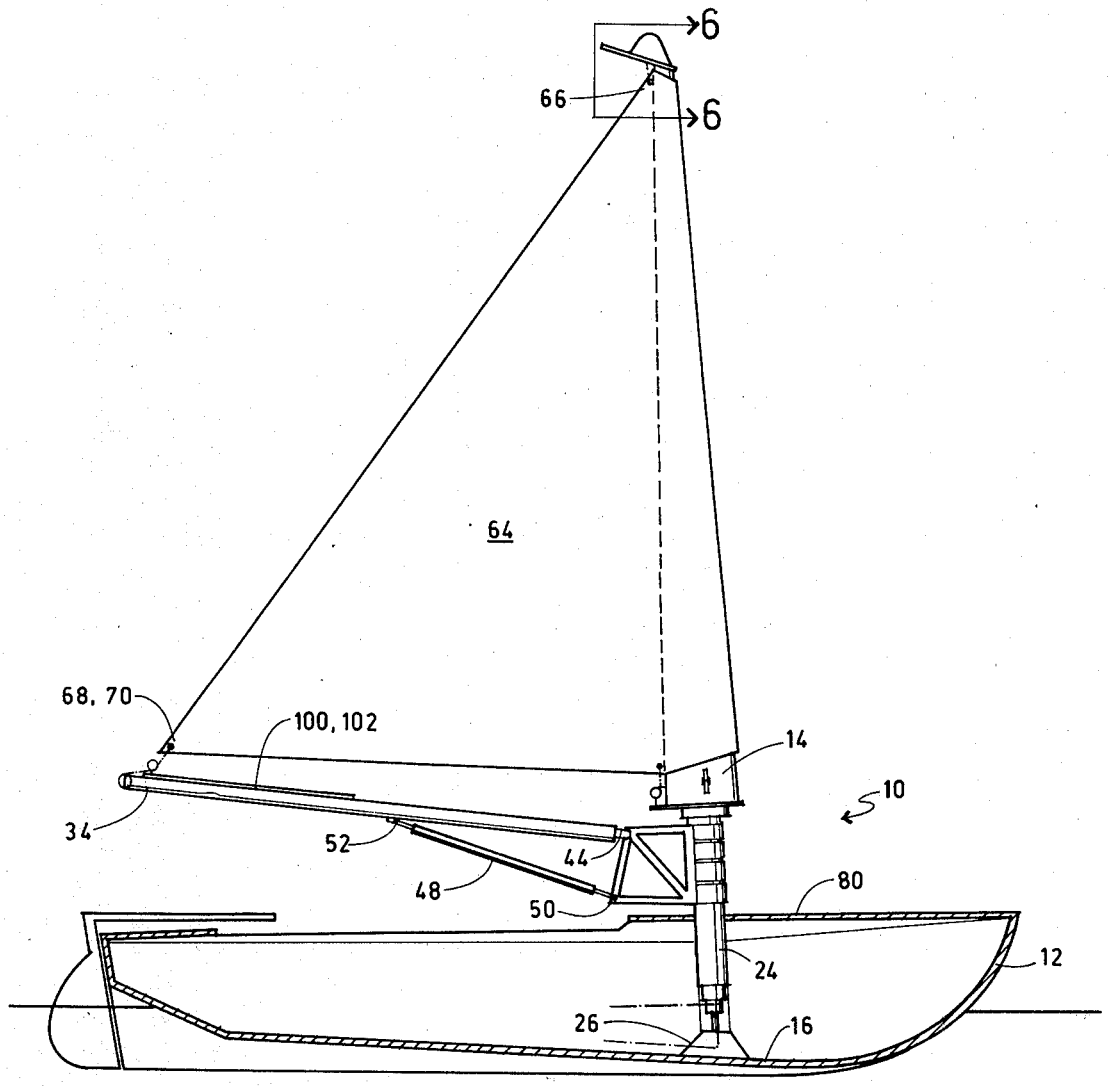
FIG. 1 is an elevation, partly in section, of a single masted sailboat embodying the invention.
Figure 2:
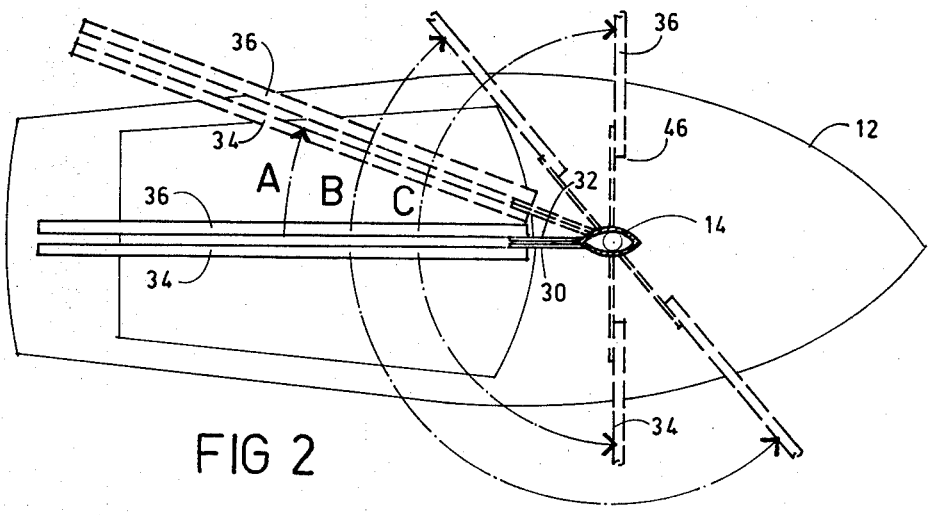
FIG. 2 is a plan view of the same illustrating how the twin booms may be used in tandem or swung to opposite sides of the vessel.
Figure 3:
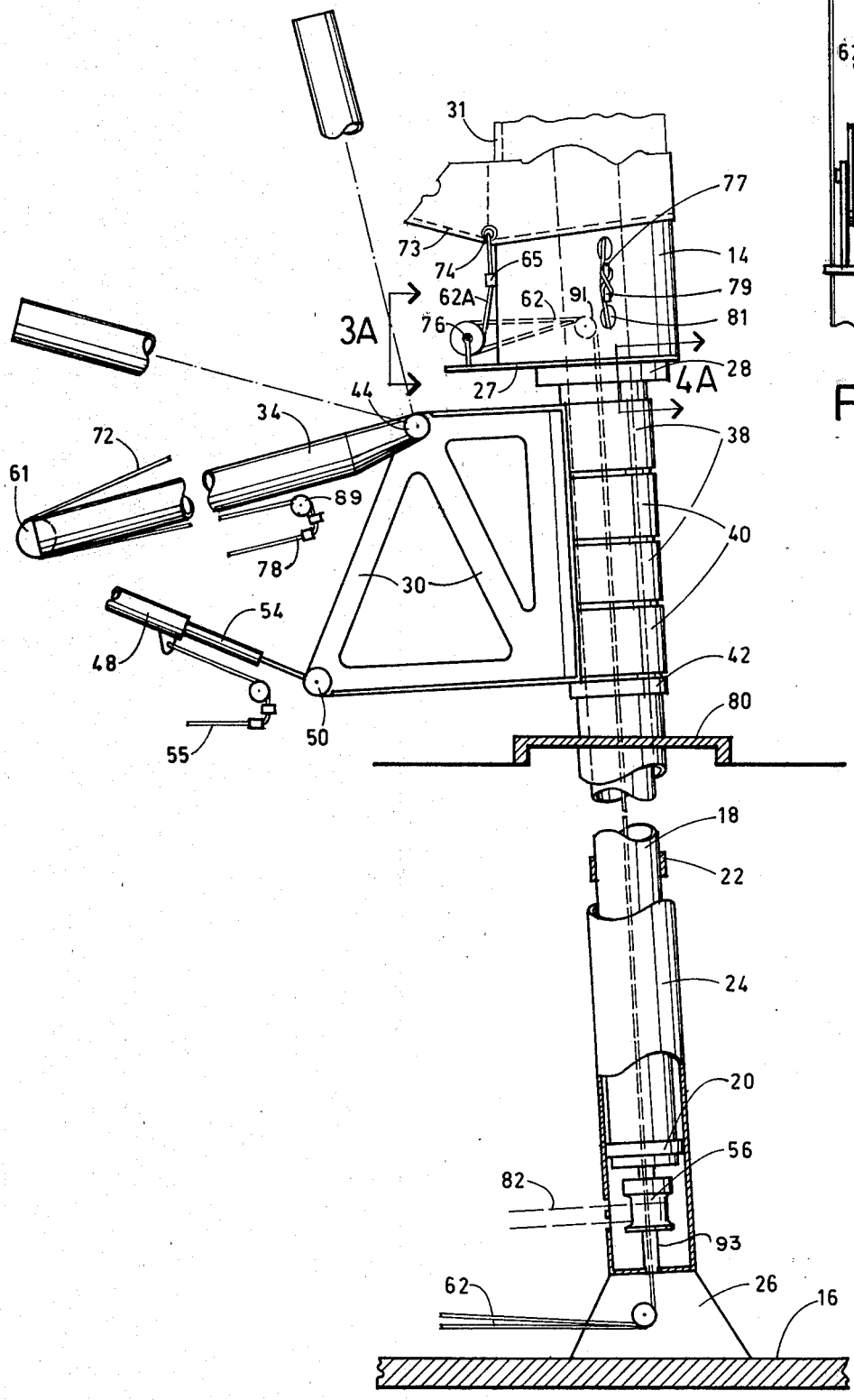
FIG. 3 is an elevation on an enlarged scale, partly in section, of the lower portion of the mast and related mechanism of the sailboat of FIG. 1 illustrating novel features of the invention.

According to the invention, I provide a novel sailboat rig, which may be applied to vessels having one, two or more masts. In one preferred manually operated embodiment, a single unit, of mast, booms and sail, is arranged as follows:

Referring to FIGS. 1–3 and FIG. 4A, the invention is shown as applied to a small sailboat 10 having a hull 12 and a rotatable mast 14. A fixed tube 24, circular in section, is built rigidly into the hull 12 of the vessel 10, extending from keel 16 through the deck 80 to a height corresponding to the normal gooseneck fitting on a vessel of comparable size; in a small dinghy this height will be 10″–15″; on a 75′ long or larger vessel it will be 6′–8′. The tube 24 is fixed to the hull 12 and keel 16 by mounting 26 in such a way as to permit access to the tube base and its interior; it is fixed to the deck so as to form a connection both rigid and watertight. At its upper end the tube 24 incorporates a flange or bearing plate 19 to take the weight of the mast 14, and appropriate bearings 21 and 28 (FIG. 4) are attached here at the tube bottom 20 and, optionally, midway, as at 22 (FIGS. 3 and 4). The tube is raked aft of the vertical by an amount between 0° and 5°.

Figure 3A:
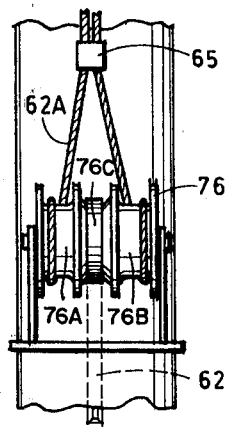
FIG. 3A is a view of a portion of the downhaul mechanism as indicated by line 3A—3A of FIG. 3.

A second, rotatable, tube 18 is set inside the above, fixed tube 24 in the bearings 20, 21, 22, and 28 which permit it to rotate freely while preventing any axial movement. This second tube acts as the lower mast, a prolongation of mast 14, and extends upwardly within mast 14 and is securely attached thereto by suitable means (not shown), such as gluing for wooden components or welding for metal components. At the base of the rotatable air foil mast 14 is the mast baseplate 27 which rotates with the mast and supports its weight on radial and thrust bearings 21 and 28; the plate 27 is extended past the downstream edge of the mast, and on this extension a downhaul 3-section sheave 76 (FIG. 3A) is mounted; the downhaul will be described below. Attached to the underside of this baseplate 27, forming part of the thrust bearings 28 is a circular cylindrical member 17 having radially inwardly turned flange 27A to prevent movement upwards or downwards of the rotating mast by bearing against top and bottom of the fixed tube flange 19. The lower of these thrust bearings 28 is suitably removable to permit unstepping and removal of the mast. The other radial bearings 20, 22, are located between the rotating tube 18 and the fixed tube 24 at points to permit smooth rotation of the upper mast 14 and rotating lower mast 18.

Figure 6:
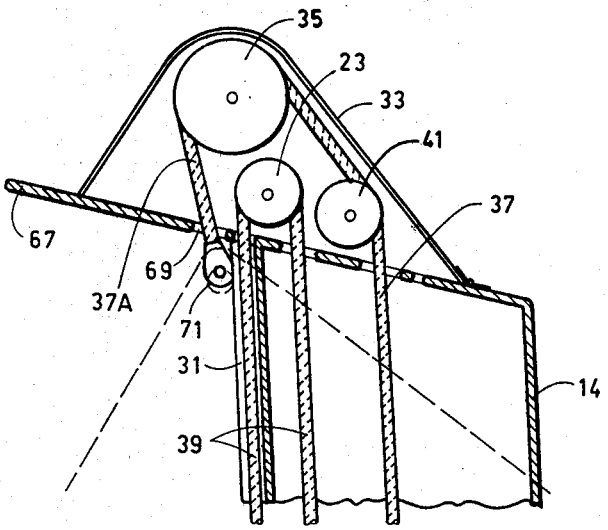
FIG. 6 is a detail in longitudinal vertical section of the top portion of the mast of the sailboat, as indicated by line 6—6 of FIG. 1, showing the arrangement of halyards and the attachment of the main halyard to the head of the sail.

The airfoil mast is tapered from its base to its tip; at its trailing edge optionally there is provided a luff groove 31 in which the luff of a storm sail may be set; its surface is otherwise smooth and unbroken. Referring to FIG. 6, at the masthead, inside a waterproof housing 33 are the sheaves 35 and 41 and sheave 23, respectively, for a main halyard 37 and a standby halyard 39. The latter, when not in use, is snugged down against the luff groove 31. The halyard sheaves are mounted on a tip plate 67 which is angled upwardly from the trailing edge of the mast at about 12½° and spreads out, fan-shaped, to both sides of the mast; this plate serves both to reduce tip vortices and to mount necessary masthead and indicating equipment. Electric wiring leads from here down the center of the mast and exits at the base of the lower mast tube.

Figures 4, 4A:
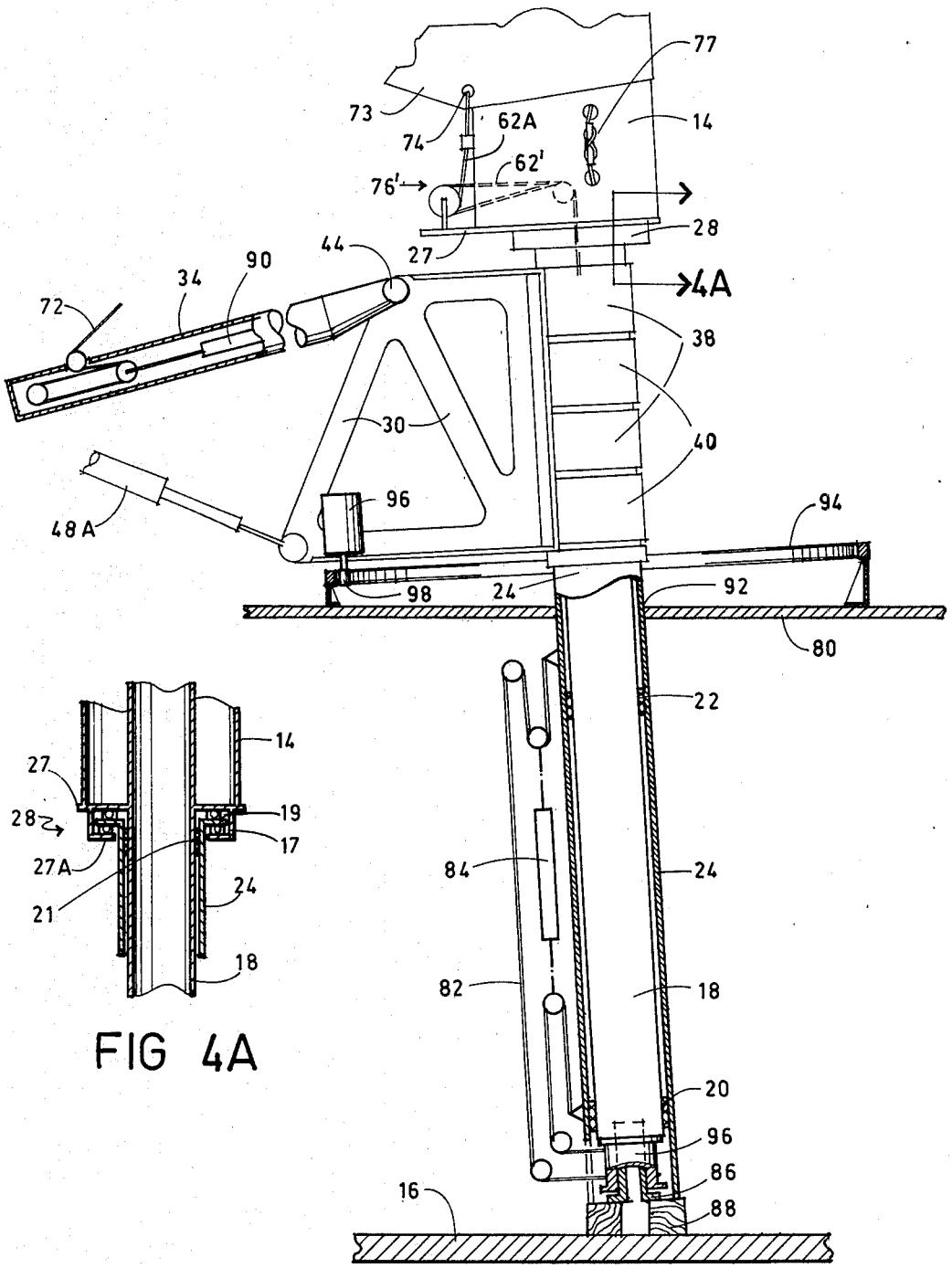
FIG. 4 is a view similar to FIG. 3 of a modified form of the invention in which power assisted mechanisms replace the manual devices shown in the previous embodiment.
FIG. 4A is a fragmentary sectional view taken on line 4A—4A of FIG. 3 or FIG. 4 showing the upper thrust and radial bearings for the rotatable mast.
Figure 5:
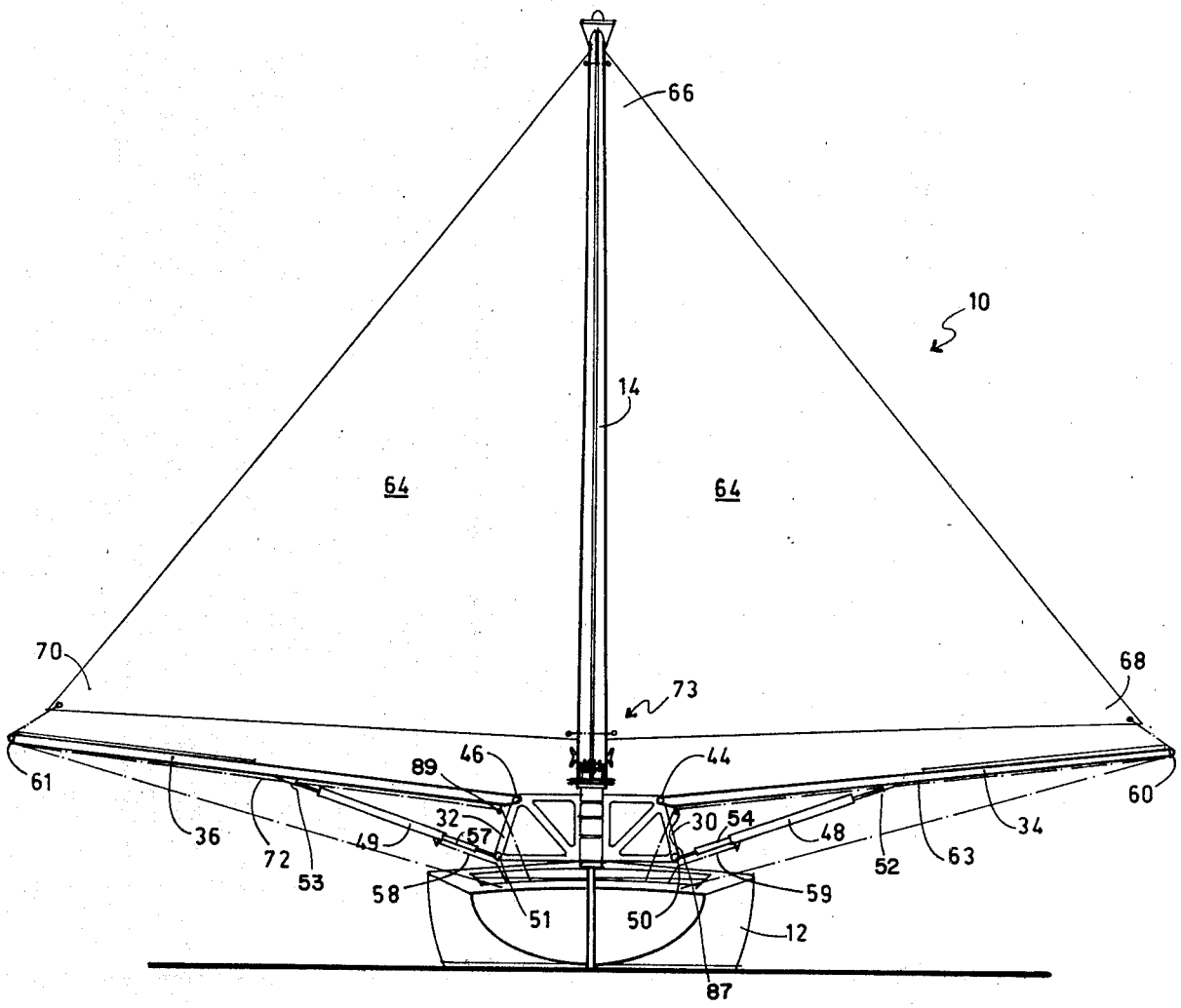
FIG. 5 is an elevation of the stern of a sailboat embodying the invention showing the twin booms swung to opposite sides of the boat.

Around the upper end of the fixed mast tube (FIG. 3) two gooseneck fittings 30, 32 are hinged by hinges 38, 40 resting on bearing ring 42. The goosenecks either lie side by side or swing independently to a separation of as much as 270°–300°. The upper outboard ends of these fittings extend beyond the baseplate 27 and downhaul sheave 76 described above; the lower end of each fitting extends beyond the upper so that each gooseneck is preferably roughly trapezoidal in shape. At the upper outboard ends of the fittings 30, 32, booms 34, 36 are so attached by means 44, 46 that each may rotate only vertically and in the plane of its gooseneck. At the lower outboard ends of the goosenecks, similarly hinged by means 50, 51, are the inner ends of combination lift-vangs 48, 49, extensible devices whose other ends are hinged at 52, 53, again similarly, at points in the mid-lengths of the booms. The two booms are thus controlled so that they may swing from a position right forward through 270°–300° to a position on the opposite side of the vessel 90° or forward 90°, to the centerline, and vertically from a position below horizontal through any desired angle up to vertical. Each boom incorporates a device to control outhaul takeup and tension, with a sliding clew attachment in tracks 100, 102 and sheaves 60, 61 at the ends of the booms through which outhaul control lines 63, 72 run to the goosenecks and thence around sheaves 87, 89 with lead 78 to the cockpit or control station in the smaller, manually-controlled embodiment, or to a hydraulically powered takeup device 90 in the fully powered embodiment of the rig (FIG. 4). In a dinghy the outhaul will go through a carcleat on the gooseneck. On larger vessels it will be led to a gooseneck swivel block on the deck and thence to a winch and stopper at the cockpit.

The vertical angle of each boom is controlled by a combination lift vang device. In the manually controlled embodiment (FIG. 3), each vang 48, 49 embodies an internal compression spring which urges its rod 54, 57 axially outwardly, thus tending to raise the boom. Control cable 58, 59 is used to exert a force to overcome the compression spring and to pull the boom down to desired elevation. In the fully powered embodiment (FIG. 4), each vang incorporates a double acting hydraulic cylinder 48A which positively raises and lowers the boom and maintains it in any adjusted position.

The sail 64 is generally triangular in shape with its upper corner comprising its head 66 adapted to be raised to the top of the mast so that when wrapped around the leading edge of the mast and its clews 68, 70 outhauled by outhauls 63, 72 passing about outhaul sheaves 60, 61 to the outboard ends of the twin booms, its double thickness fills the triangular area defined by the mast and booms. The head 66 and the tack 73 have each two thimbles 71 and 74 so spaced that when the sail is passed around the mast they lie on its opposite sides at the trailing edge. Those 71 at the head are attached to the split tails 37A of the halyard 37, which then lead through a fairlead hole 69 in the tip plate 67, over the halyard sheaves 35, 41, which are wide enough to take the two leads 37A or the single line 37, and down through the mast to the exit 77 above the baseplate 27 for being made fast to cleat 79, the surplus being stored inside mast 14 after being fed through opening 81. The halyard 37 divides into two leads 37A a sufficient distance from connectors 71 so that when the halyard is slacked there is sufficient slack in the leads to permit the head 66 to drop to the base of the tapered mast 14.

To the tack thimbles 74 are attached the two parts 62A of the downhaul which then lead through a fairlead 65 on the trailing edge of the mast, to a combination spool and sheave 76. This device has twin outboard takeup spools 76A, 76B separated from each other by a V-pulley 76C all keyed together Twin leads 62A may wind and unwind on the two spools while the continuous downhaul cable 62 may drive the V-pulley. Both runs of cable 62 pass from the pulley to the inside of the rotating tube 18, thence around twin sheaves 91, and down the center of the tube about fairlead 93 and out through the hub of the mast rotating device 56 to the control station (cockpit) where they may be tensioned by means of a tensioning device such as a conventional winch (not shown) which may be manually operated or powered. Thus, to tighten the downhaul one run of the line 62 is tensioned which winds up the leads 62A on the spools. Releasing the tension permits wind pressure on the sail to pull the leads 62A off their respective spools.

In the larger embodiment, the manual downhaul is modified to use power. The three-section combination spool V-sheave arrangement 76 of the prior embodiment has been changed to a unit 76' having three side by side wind-up spools keyed together. The two outer spools act as before, but a single cable 62' is arranged to wind up on the center take-up spool. This wire passes down through the mast to the cockpit where it may be tensioned by a suitable powered device, such as a winch. When the sail is snugged down around the mast, the line 62' is under tension, most of it withdrawn from its spool, and all the extra downhaul cable leads 62A are wound around the two outer take-up spools of the unit 76' . The center section is empty. When tension on the downhaul is released the wire 62' winds up on the center section of the three-part spool and the leads 62A are relaxed and unwind from their respective spools. In the case of still larger vessels it may be desirable to substitute an electrical drive for the cable drive, in which case only electric wires from an electric motor need be led from the unit through the mast to the control station.

The clews 68, 70 of the sail are provided with means travelling in partial tracks 100, 102 on the upper surface of each boom to assist in holding the clews in proper position when the sail sections are outhauled.

Referring further to the embodiment of FIG. 4, mechanical devices, hydraulic, electrical or mechanical, are used as needed to provide appropriate mechanical advantage to operate the rig from a central control station, normally the vessel's steering station. These will normally be: devices to rotate the mast, to set up the downhaul, to control boom height, to control outhaul position and tension, and to control boom angle.

In this embodiment, the same numerals indicate elements which are essentially the same as the other embodiment. However, in place of manually operated devices, hydraulic or electric powered units have been substituted. Thus, to rotate the mast 14, a hydraulic cylinder 84 has been provided. The mast rotation cable 82 is passed about appropriate sheaves and the double acting hydraulic cylinder 84 rotates the mast through the spool 96 keyed to the base of the lower mast rotatable tube 18. Centering base 86 is mounted on timbers 88 and has a hollow core to permit passage of electrical wiring and control cables from the upper mast.

Within each boom (one boom 34 being shown in FIG. 4) there is provided hydraulically powered means 90 for driving the outhaul cable 72. Since such means is known per se, it has been shown only schematically. Combination lift vangs 48, 49 operate as before, but are suitably powered to handle the greater load. To reduce water leakage the tube 24 is preferably bonded to the deck member 80 as indicated at 92.

Likewise, in a larger vessel with greatly increased sail area, it is necessary to provide a power drive to swing each boom to the desired angle relative to the centerline of the vessel, and when it is desired to switch from a side by side boom situation to deploying both booms. For this purpose there is provided a ring gear 94. Each gooseneck 30, 32 carries a hydraulic boom angle drive motor 96 which drives pinion 98 which, in turn, engages the teeth of ring gear 94. By appropriate hydraulic controls (not shown) the motors can be actuated from the control station to swing the gooseneck and booms in either direction. Any combination of the manual and mechanical devices indicated may be employed in an individual application to tailor the controls to the demands of that particular application.

With a fully powered rig it should be possible for a minimal crew to safely operate a large multi-masted vessel since most functions of sailing may be performed by remote control without need for manual intervention. This would thus make feasible the use of sail as auxiliary propulsion for supertankers, etc.

OPERATION

Figure 7:
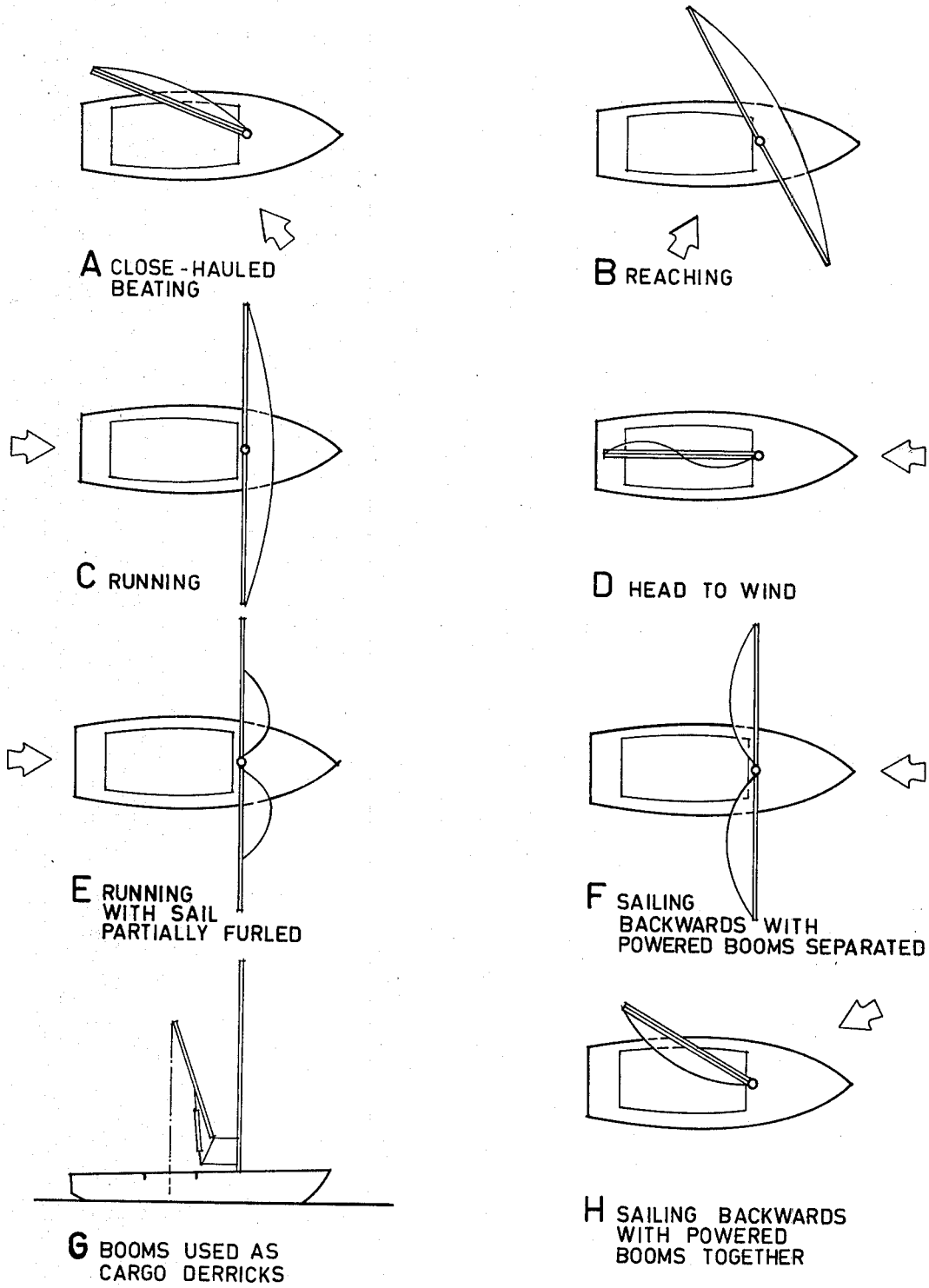
FIGS. 7A, B, C, D, E, F, G and H are diagrammatic representations on a reduced scale showing different sail settings and different adjusted positions and uses of the twin booms made possible by the invention.

When the vessel is at rest, moored, anchored, or alongside a dock or float, the sail is fully wrapped around and secured to the mast by rotating the latter. To get underway, the sail is released and the mast is rotated to set as much sail as conditions call for (FIG. 7D). All normal sailing maneuvers are then carried out in the usual manner, except that for beating to windward no sheet changes need be made when tacking, and the operator need not leave his station to make any trim or shape adjustments. In moderate conditions, and generally when beating to windward, the sail will be completely unrolled and set double with the booms lying side by side (FIG. 7A). In light airs, and for reaching and running in moderate breezes, the booms may be separated, the downhaul released and the sail set as a single shape of double the normal size (FIGS. 7B and 7C). For heavier weather, the sail may be set with one or more turns left wrapped around the mast to reduce area (half turns may also be used). When so set, the booms may still be separated for more effective downwind work (FIG. 7E). In very severe conditions, the sail may be completely wrapped, and the air foil mast used, by controlling angle of rotation, as a rigid sail of limited area. The mast is most effective in this mode if the sail is handed; however, this maneuver requires that the operator leave his station to handle halyard and sail. Mast rotated angle may be controlled for minimum windage in severe conditions.

The operation of the embodiment of FIG. 4 of the invention is essentially the same as that of FIGS. 1–3 except that it is power driven and subject to push-button control from the control station, thus making it more suitable for larger vessels. This embodiment, however, has further capabilities which would not be entirely expected. Thus with power available to rotate the booms it is possible to sail the boat backwards because the ring gear and pinion arrangement permits each boom to be swung so that wind coming squarely or obliquely over the bow fills the sail sternwardly, that is, in the direction opposite to that for forward sailing. This capability is illustrated in FIGS. 7F and 7H. In FIG. 7F the booms are separated 90° to each side of the vessel and held there by the power boom drive. The sail sections are filled sternwardly, as shown, by wind coming squarely or obliquely over the bow and the vessel will be driven backward. This feature permits the sailor to maneuver more readily in close quarters and to brake the vessel without use of an auxiliary engine. With large, heavy vessels a braking ability can be most useful. FIG. 7H shows a similar feature when the booms are side by side, both being rotated to one side to cause the opposite side of the sail to face the wind.

In the case of cargo vessels, such as cargo-carrying schooners or sail-power assisted ships, one of the drawbacks is the presence of conventional booms when it is desired to load or unload the cargo. The booms get in the way of the shore-side derricks used for this purpose. With the rig of the invention it is possible to use the vessel's booms themselves as derricks for this purpose (FIG. 7G). The sails are furled by winding them up on the masts or removed. The booms are now free to be raised and lowered by the powered combination vangs and swung by the ring gear-pinions arrangement. Hoisting cable can be run over the sheaves 60, 61 and powered by suitable winches. Loading and unloading can proceed as with conventional freighters.

While there has been herein disclosed and described presently preferred embodiments of the invention, it will nevertheless be understood that the same is susceptible of modification and changes by those skilled in the art and, therefore, it is intended that the scope of the invention be limited only by the proper interpretation to be accorded the following claims.

I claim:

1. In a sailboat having a rotatable mast, in combination, twin booms pivotally connected to the lower part of the mast so as to swing independent of mast rotation in a horizontal plane together to the same side of the boat or separately to opposite sides of the boat, and a single, generally triangular sail passed around the mast and adapted to be rolled up thereon or unrolled therefrom when the mast rotates with one corner of the triangle comprising the head of the sail, the other two corners comprising the clews, and the base of the sail, where it passes about the mast, comprising the tack, the tack being releasably attached to the mast, said clews being adapted for outhauling one on each boom when said mast rotates in its unrolling direction whereby when said booms are together and said sail sections outhauled along their respective booms, one-half the unrolled said area is exposed to the wind to provide an efficient air foil leading edge at the mast for conventional sailing, when said booms are separated, the entire unrolled sail area is exposed to the wind for running and reaching, and when said booms are separated, said sail is fully unrolled, and said tack is released from said mast, the full area of the sail is exposed to the wind, as an unbroken air foil, separated from and without interference from the leading edge of the mast, for running and reaching.

2. The combination as claimed in claim 1 including means for rotating said mast whereby said sail may be rolled up entirely or only partially on the mast permitting incremental reefing in proportion to the number of turns of the mast.

3. The combination as claimed in claim 1 including twin goosenecks supporting said booms for swinging in both horizontal and vertical planes.

4. The combination as claimed in claim 3 in which each of said goosenecks is so shaped as to provide maximum movements of its attached boom in both horizontal and vertical planes, with positive control of such movements.

5. The combination as claimed in claim 4 in which each of said goosenecks is generally trapezoidal in configuration with its booms pivoted at the outboard upper corner and having combination lift vang means pivotally connecting its outboard lower corner to the corresponding boom.

6. The combination as claimed in claim 3 including means controllable from the control station of said boat for swinging said goosenecks and booms.

7. The combination as claimed in claim 6 wherein said means for swinging said goosenecks and booms comprises a ring gear engaged by individual pinions in driving relation to the said goosenecks respectively so that they may be individually or together swung horizontally through any desired arc and power means for actuating said pinions.

8. The combination as claimed in claim 1 including an upwardly sloping vortex plate at the top of the mast and means for raising and holding the head of said sail to the top of the mast, said means including a halyard and twin leads therefrom connected to spaced connecting means at the sail head which, when said sail is fully raised, are located on either side of the trailing edge of the mast and against the underside of the vortex plate.

9. The combination as claimed in claim 8 including downhaul means controllable from the boat's control station connected to the tack of said sail for holding said tack against the base of the mast.

10. The combination as claimed in claim 1 wherein said mast is supported on the hull of said boat by a fixed tube extending from the bottom of the mast to the boat's keel, rigidly attached to both deck and keel, and including means for rotating said mast comprising a rotatable tube journaled within said fixed tube in driving relation to said mast and means for rotating said rotatable tube.

11. The combination as claimed in claim 10 including twin goosenecks pivotally supported on said fixed tube for supporting said booms for swinging together or separately in a horizontal plane.

12. The combination as claimed in claim 10 wherein said means for rotating said rotatable tube includes a cable passed about a spool affixed to the base of said rotatable tube.

13. The combination as claimed in claim 11 including means pivoting said booms to said goosenecks for swinging in vertical planes through any desired angle including the vertical.

14. The combination as claimed in claim 13 including a hydraulically powered combination lift vang interconnecting each boom to a portion of its gooseneck and means controllable from the control station of said boat for actuating said vangs so as to raise or lower said booms and maintain them at the desired elevation.

15. The combination as claimed in claim 13 including combination lift vangs interconnecting each boom to a portion of its gooseneck so as normally to urge said boom upwardly and control means acting against the force of said lift vangs for preventing such upward movement and positively adjusting the vertical positions thereof.

16. The combination as claimed in claim 15 wherein each gooseneck is generally trapezoidal in shape with a vertical edge adjacent the mast hinged to said fixed tube for swinging horizontally permitting arcuate separation of said booms through an arc of the order of 270°–300°, its boom being pivoted for vertical swinging movement to its outboard upper corner and its vang pivoted to its outboard lower corner.

17. The combination as claimed in claim 15 including power means controllable from the control station of said boat for actuating said means for rotating said rotatable tube.

18. The combination as claimed in claim 1 including power means for swinging said booms together in the same direction or separately in opposite directions whereby, when the boat is headed squarely or obliquely into the wind, the sail may be positioned to face the wind thereby braking said boat or driving it in reverse.

19. The combination as claimed in claim 18 including power means for raising and lowering each boom whereby when no sail is set the booms may be used as derricks for loading and unloading cargo from said boat.

* * * * *

UNITED STATES PATENT AND TRADEMARK OFFICE

CERTIFICATE OF CORRECTION

PATENT NO. : 4,367,688

DATED : January 11, 1983

INVENTOR(S) : Thomas B. A. Godfrey

It is certified that error appears in the above-identified patent and that said Letters Patent are hereby corrected as shown below:

Col. 1, line 36: "trunbuckles" should be "turnbuckles"

Col. 1, line 58: "said" should be "sail"

Col. 1, line 67: "said" should be "sail"

Col. 5, line 55: After "together" insert --.--

Col. 8, line 36: "said" should be "sail"

Signed and Sealed this

*Twenty-second* Day of *March 1983*

[SEAL]

*Attest:*

GERALD J. MOSSINGHOFF

*Attesting Officer*

*Commissioner of Patents and Trademarks*